US006017134A

United States Patent [19]

Wang

[11] Patent Number: 6,017,134

[45] Date of Patent: Jan. 25, 2000

[54] LAMP STRING HOLDING FRAME

[76] Inventor: Jessica Wang, 16F-3, No. 70, Sec. 2, Tunha Road, Taipei, Taiwan

[21] Appl. No.: 09/083,181

[22] Filed: May 22, 1998

[51] Int. Cl.[7] ..... F21P 1/00

[52] U.S. Cl. ..... 362/252; 362/249; 362/391; 362/806

[58] Field of Search ..... 362/121, 249, 362/252, 382, 391, 806, 807, 808; 206/419, 420

[56] References Cited

U.S. PATENT DOCUMENTS

| | | | |
|---|---|---|---|
| 4,852,832 | 8/1989 | Delaney | 362/249 |
| 5,526,246 | 6/1996 | Liou | 362/252 |
| 5,544,028 | 8/1996 | Carlin | 362/249 |

*Primary Examiner*—Darren E. Schuberg
*Attorney, Agent, or Firm*—Bacon & Thomas, PLLC

[57] ABSTRACT

A lamp string holding frame includes at least one frame section having two elongated members spaced from each other to define therebetween a spacing with a plurality of connecting members arranged between and connected to the two elongated members in a spaced manner. Each of the connecting members is formed with a lamp holder having two opposite arms spaced from each other to define therebetween a spacing for accommodating and securely holding the lamp therein. At least one of the two elongated members is provided with a plurality of sets of wire securing tabs disposed along the length thereof. Each of the sets includes at least one, preferably a plurality of wire securing elements includes a flexible tab fixed to and extending therefrom and spaced from each other to allow the wires to extend through the spacing between tabs in such a manner of being alternately above and below the tabs. Preferably, the tabs are provided with an end boss projecting substantially normal to the tabs alternately in two opposite directions for more securely holding the wires.

8 Claims, 5 Drawing Sheets

LAMP STRING HOLDING FRAME

FIELD OF THE INVENTION

The present invention relates generally to a lamp string, such as a Christmas lamp string, and in particular to a lamp string holding frame on which the lamp string may fixed to provide a particular figure or pattern, especially when lightened so as to be more appealing to the general consumers.

BACKGROUND OF THE INVENTION

Lamp strings, such as those used in for example Christmas, are well known and widely used in holidays and festivals for making joyful atmosphere. The lamp strings usually comprise a set of wires that usually has two wires for supplying electricity and a plurality of lamp sockets physically and electrically connected to the wires with lamps received and held in each of the sockets. The wires are usually flexible so as to allow a user to attach the lamp string to a fixture with the wires extending along a desired path to form a desired pattern, such as a cartoon figure, or a particular shape, such as a star.

To provide a convenient way to mount the lamp string in a particular pattern, some of the lamp string manufacturers provide a holding frame of a configuration corresponding to the particular pattern with the lamp string fixed thereon. Some of the lamp string holding frames are made of an elongated piece of material, such a long strip-like plate, which has a plurality of holes formed thereon to each receive a lamp therein so as to hold the lamp on the elongated piece of material.

The piece of material that forms the lamp string holding frame is substantially located on a plane or defines a plane and the holes on the elongated material piece have the shape corresponding to the lamp so as to snagly receive the lamp therein in such a way that the lamp lies substantially on the plane of the material piece of the holding frame. This allows the light of the lamp to be observed from both side of the material piece.

However, such a lamp string holding frame provides no lamp securing means so that the lamps are simply held within the holes by means of snag fitting therebetween. Thus it is very likely that the lamps may get off the holding frame due to for example external force and vibration occurring on the holding frame. Further, the conventional lamp string holding frame of this type also provides no wire securing means so that the wires are loosely hung between two successive lamps which connected to the wires.

Thus, it is desirable to provide an improvement over the lamp string holding frame of the above mentioned type which allows the lamps and the wires connecting the lamps to be securely held on the holding frame.

SUMMARY OF THE INVENTION

Therefor, an object of the present invention is to provide a lamp string holding frame which securely holds the lamps thereon to allow the light emitted from the lamps to be observed from both side of the lamp string holding frame so that the lamp may not get off the holding frame simply due to for example vibration of the holding frame.

Another object of the present invention is to provide a lamp string holding frame of the type that allows the light of the lamps to be observed at both sides of the holding frame comprising means to secure the wires of the lamp string thereon.

To achieve the above objects, in accordance with the present invention, there is provided a lamp string holding frame comprising at least one frame section comprising two elongated members spaced from each other to define therebetween a spacing with a plurality of connecting members arranged between and connected to the two elongated members in a spaced manner. Each of the connecting members is formed with a lamp holder comprising two opposite arms spaced from each other to define therebetween a spacing for accommodating and securely holding the lamp therein. At least one of the two elongated members is provided with a plurality of sets of wire securing tabs disposed along the length thereof. Each of the sets comprises at least one, preferably a plurality of wire securing elements comprises a flexible tab fixed to and extending therefrom and spaced from each other to allow the wires to extend through the spacing between tabs in such a manner of being alternately above and below the tabs. Preferably, the tabs are provided with an end boss projecting substantially normal to the tabs alternately in two opposite directions for more securely holding the wires.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
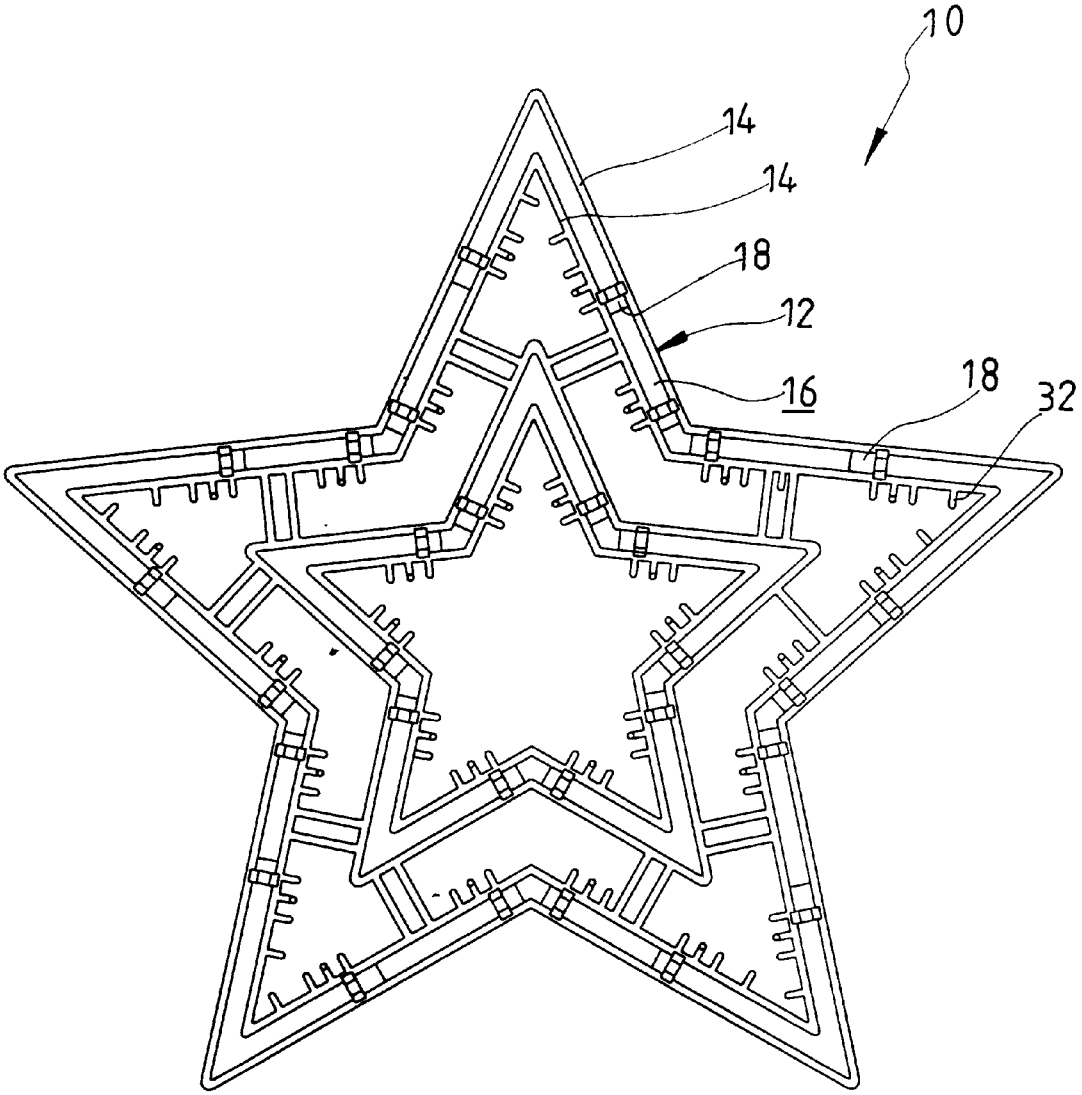
FIG. 1 is a plane view showing a lamp string holding frame constructed in accordance with an embodiment of the present invention.

With reference to the drawings and in particular to FIG. 1, wherein a lamp string holding frame constructed in accordance with the present invention, generally designated with reference numeral 10, is shown, the lamp string holding frame 10 of the present invention comprises at least one frame section 12. Preferably, there are a plurality of frame sections 12 connected together to define a particular configuration, such as a star as shown in FIG. 1. Quite apparently, the frame sections 12 may be connected in different ways to define different configurations.

Figure 2:
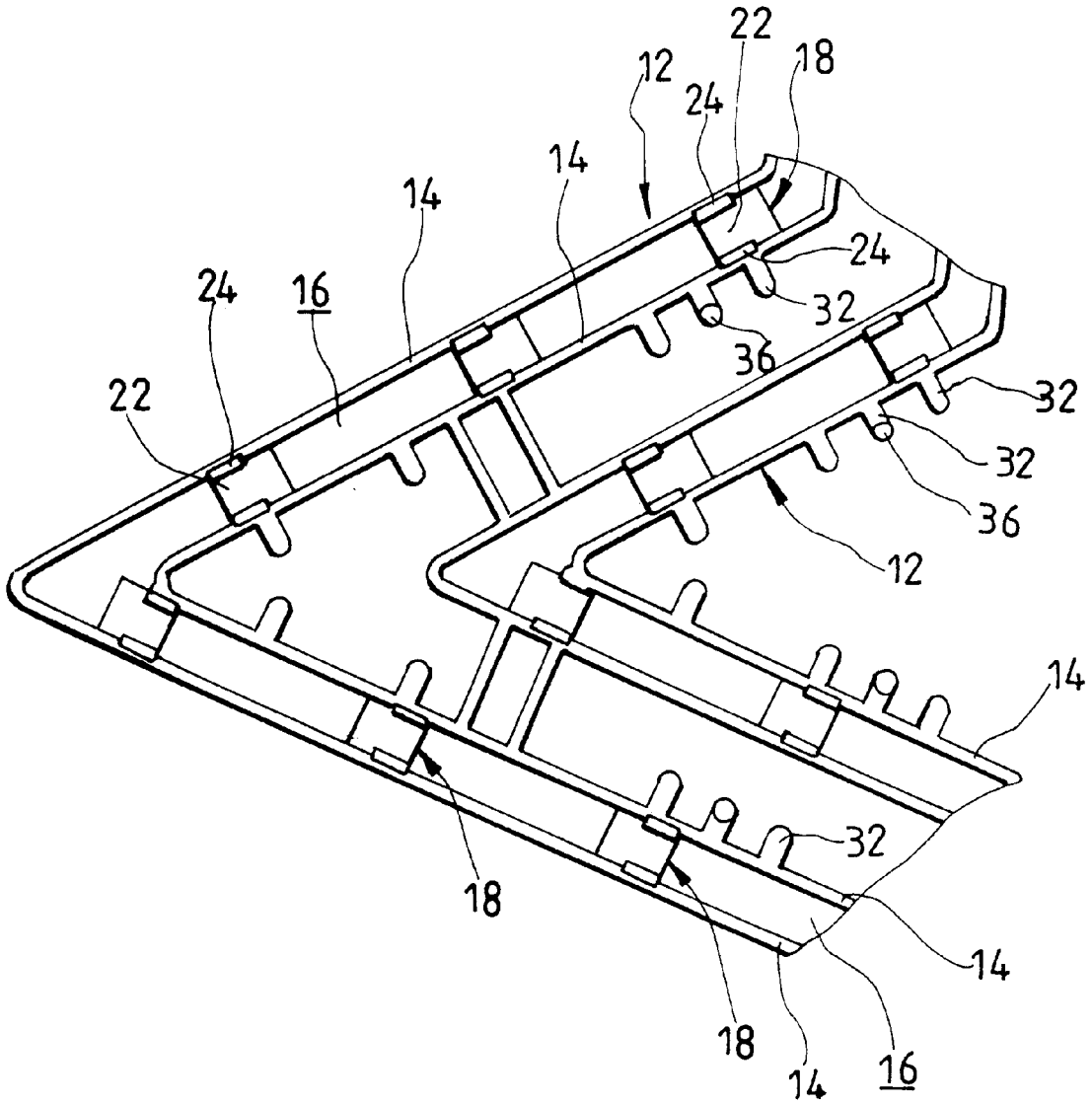
FIG. 2 is a plane view of a portion of the lamp string holding frame of the present invention in a larger scale.

Also referring to FIG. 2, which shows a portion of the lamp string holding frame 10 shown in FIG. 1 in a larger scale, each of the frame sections 12 of the lamp string holding frame 10 comprises two elongated members 14 spaced from each other to define therebetween a spacing 16 with a plurality of lamp holders 18 arranged within the spacing 16 in a spaced manner along the length of the elongated members 14 and connected to the two elongated members 14 so as to fix the elongated members 14 together to define the frame section 12.

Figure 3:
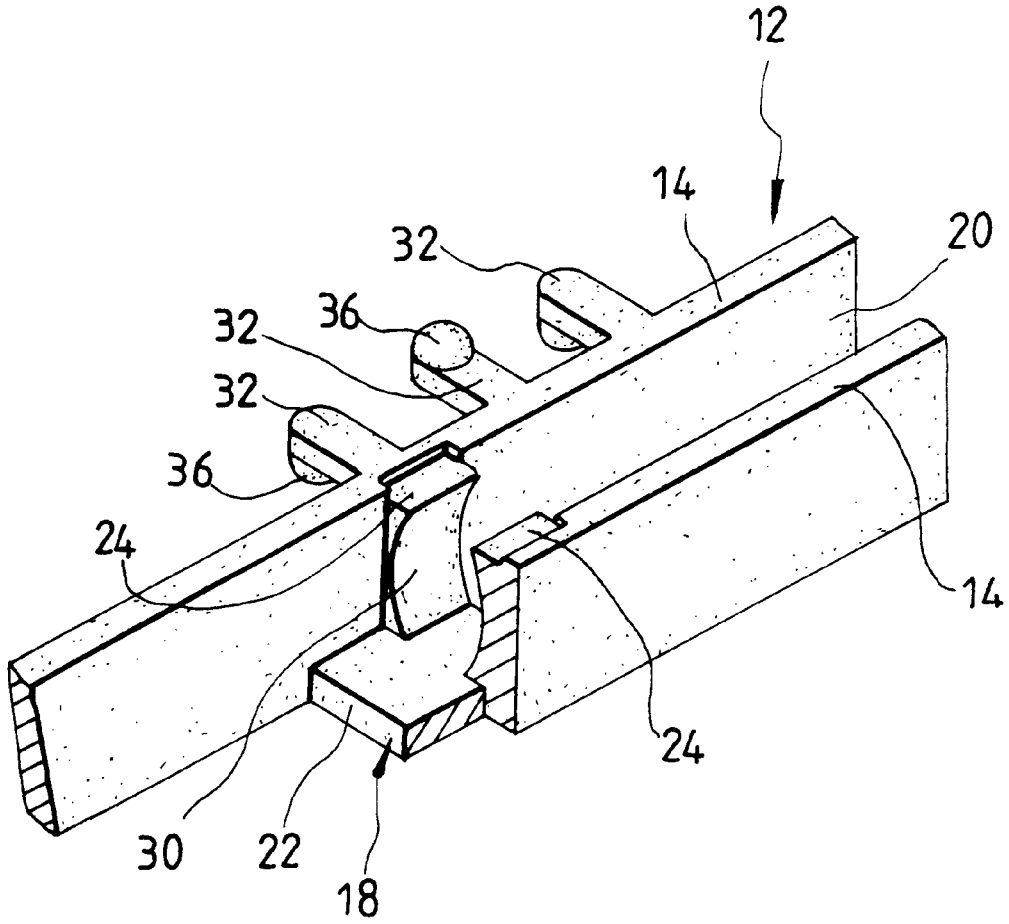
FIG. 3 is a perspective view of a portion of the lamp string holding frame of the present invention, partially in section, in a still larger scale.
Figure 5:
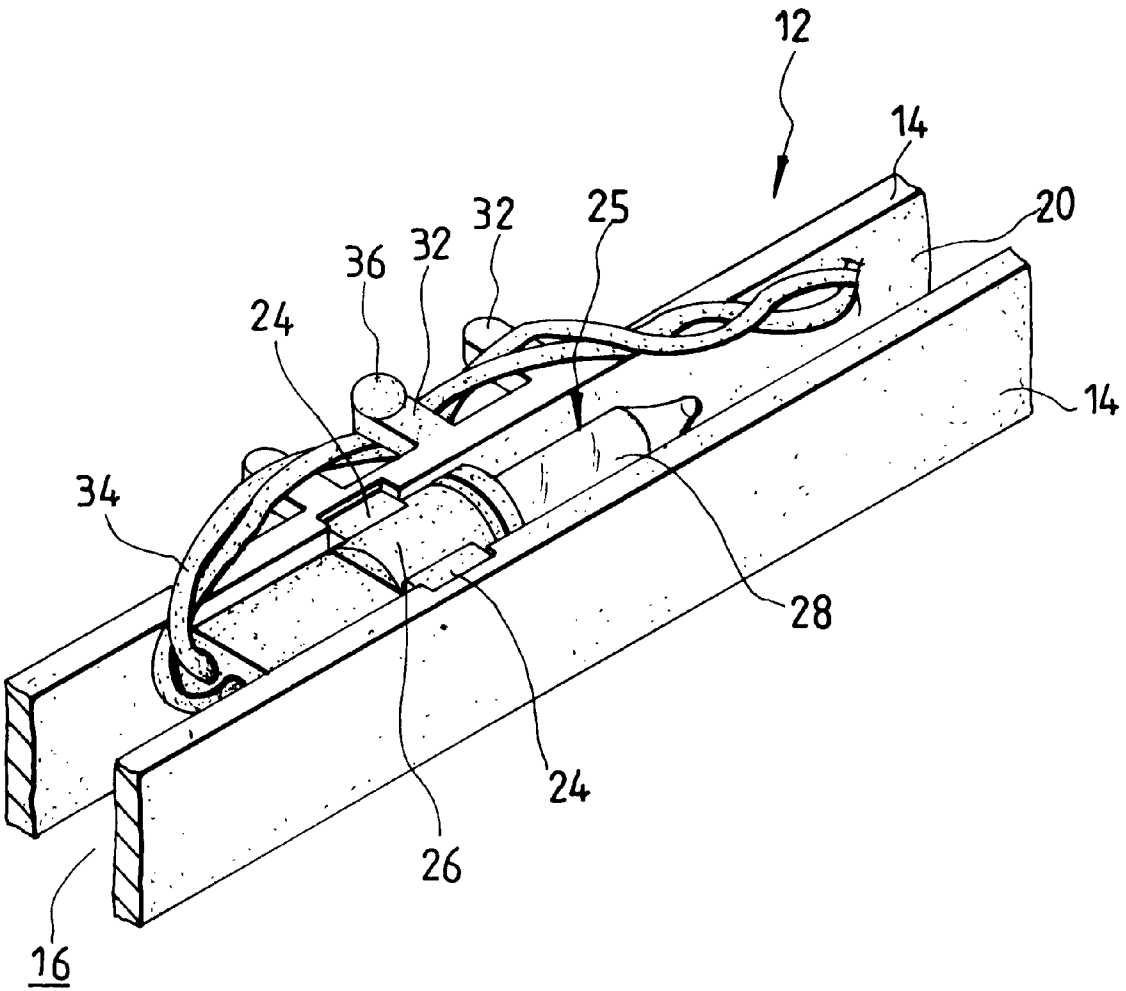
FIG. 5 is a perspective view of a larger scale showing the lamp mounted in the lamp holder of the lamp string holding frame of the present invention.

Further referring to FIG. 3, the two elongated members 14 may each define an inside wall 20. Each of the lamp holders 18 comprises a base 22 connecting between the inside walls 22 of the elongated members 14 and two opposite arms 24 extending from the base 22 and spaced from each other to define therebetween a spacing sized to receive and hold therein a lamp 25 having a socket 26 with a lamp bulb 28 mounted therein (see FIG. 5). Preferably, each of the arms 24 has a concave configuration 30 for more securely holding the lamp 25, preferably at the socket 26 of the lamp 25.

In the embodiment illustrated, the wall 20 of each of the elongated members 14 has a height substantially corresponding to the lamp socket 26 (as well as the lamp 28) of the lamp 25 for completely shielding the lamp 25 at two opposite sides. The arms 24 are preferably integrated with or connected to and extending with the height of the wall 20.

Figure 4:
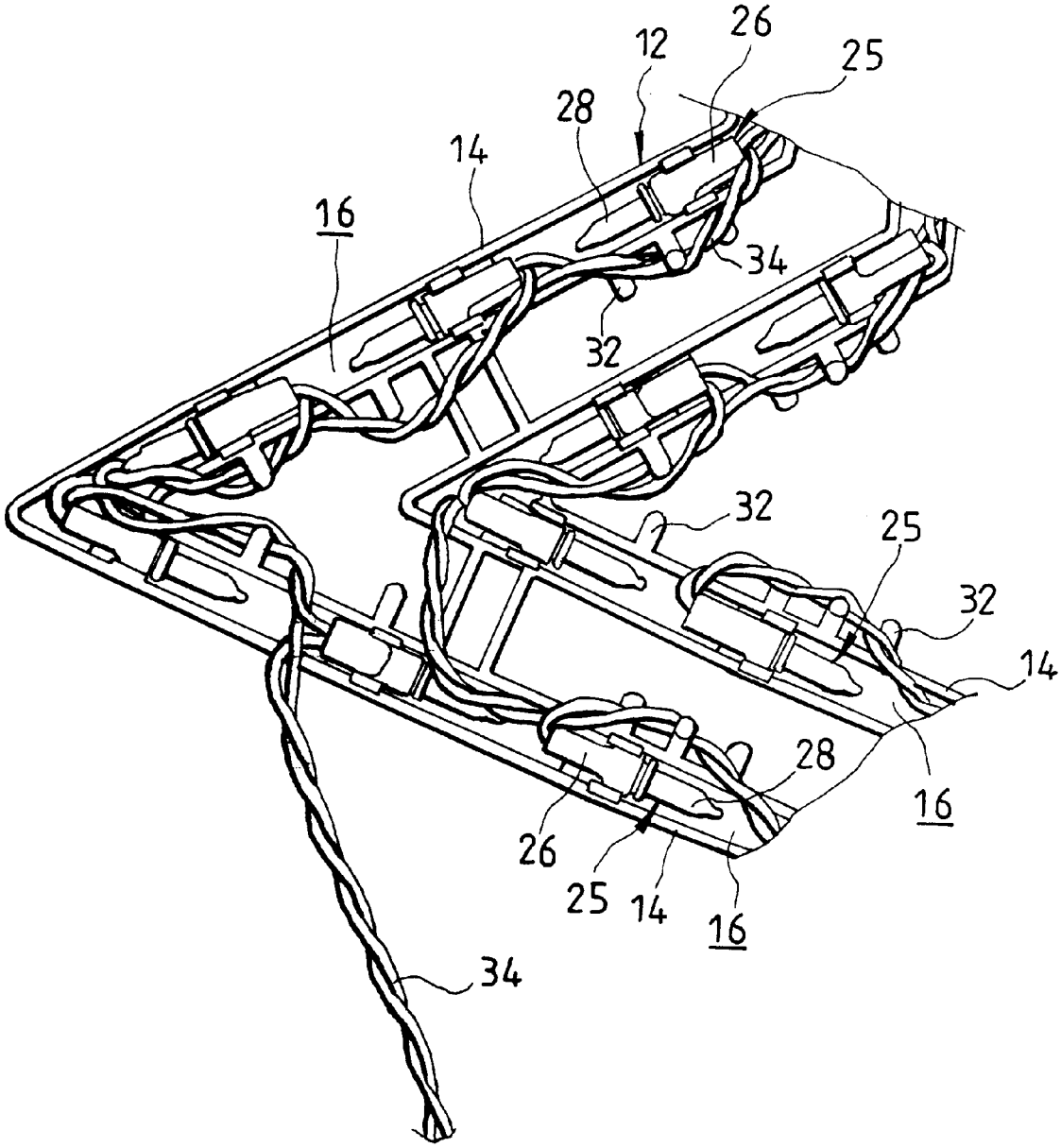
FIG. 4 is a plane view similar to FIG. 2 with lamps mounted therein.

At least one of the elongated members 14 is provided with a plurality of sets of wire securing tabs 32 disposed along the elongated member 14. Each of the wire securing tabs 32 is fixed to the elongated member 14 and extending therefrom in a direction substantially normal to the length of the elongated member 14. The wire securing tabs 32 of each set are spaced from each other at a suitable distance so as to allow wires 34 (see FIGS. 4 and 5) of the lamp 25 to extend therethrough in such a way to be alternately above and below the wire securing tabs 32 (see FIGS. 4 and 5) and thus fixed thereby. Preferably, the wire securing tabs 32 are made resilient.

Preferably, each of the wire securing tabs 32 has a free end on which a boss 36 is provided which projects in a direction substantially normal to the wire securing tab 32. The bosses 36 of the wire securing tabs 32 of each of the sets are arranged to be alternately in opposite directions so as to provide means for preventing the wires 34 from readily getting off the wire securing tabs 32.

Although the a preferred embodiment has been described to illustrate the present invention, it is apparent that changes and modifications in the specifically described embodiment can be carried out without departing from the scope of the invention which is intended to be limited only by the appended claims.

What is claimed is:

1. A lamp string holding frame for holding a lamp string thereon comprising a plurality of wires and a plurality of lamps connected to the wires, the lamp string holding frame including at least one frame section having two elongated members spaced from each other to define therebetween a spacing within which a plurality of connecting members, each defining a lamp holder, are arranged for connection to the two elongated members, each of the lamp holders including two opposite arms defining therebetween a spacing for accommodating and securely holding one of the lamps so as to hold the lamp string on the lamp string holding frame, wherein at least one of the elongated members includes a plurality of sets of wire securing tabs disposed along the length of the elongated member, each set having at least one wire securing tab which is fixed to the elongated member and extending therefrom in a direction substantially normal to the length thereof for holding the wires thereon.

2. The lamp string holding frame as claimed in claim 1, wherein each of the elongated member has an inside wall having a predetermined height and wherein the connecting member comprises a base extending between inside walls of the elongated members, the two arms extending from the base and along the height of the inside wall.

3. The lamp string holding frame as claimed in claim 1, wherein each of the arms defines a concave configuration for more securely holding the lamp.

4. The lamp string holding frame as claimed in claim 2, wherein each of the arms defines a concave configuration for more securely holding the lamp.

5. The lamp string holding frame as claimed in claim 1, wherein each set includes a plurality of wire securing tabs fixed to and extending from the elongated member and spaced from each other along the length of the elongated member at a predetermined distance to allow the wires to extend therethrough in a manner that the wires are disposed alternately above and below the wire securing tabs.

6. The lamp string holding frame as claimed in claim 1, wherein each of the wire securing tabs has a free end on which a boss is formed for holding the wires on the tab.

7. The lamp string holding frame as claimed in claim 1, wherein each of the wire securing tabs of each of the sets has a free end on which a boss is formed to alternately extend in opposite direction with respect to the wire securing tabs.

8. The lamp string holding frame as claimed in claim 1, wherein the wire securing tab is resilient.

* * * * *